United States Patent [19]

Goralnik

[11] Patent Number: 4,709,313

[45] Date of Patent: Nov. 24, 1987

[54] LAMP SOCKET AND LIGHT FIXTURE CONNECTION

[76] Inventor: Charles D. Goralnik, 1825 N. 19th St., St. Louis, Mo. 63106

[21] Appl. No.: 5,613

[22] Filed: Jan. 21, 1987

[51] Int. Cl.[4] ..... F21S 1/12

[52] U.S. Cl. ..... 362/414; 362/429; 362/405

[58] Field of Search ..... 362/414, 368, 429, 430, 362/431, 405, 226

[56] References Cited

U.S. PATENT DOCUMENTS 2,254,679 9/1941 Gaskill ..... 362/414

4,499,527 2/1985 Tauber et al. ..... 362/431

FOREIGN PATENT DOCUMENTS 842685 6/1952 Fed. Rep. of Germany ..... 362/429

*Primary Examiner*—Craig R. Feinberg

*Assistant Examiner*—David A. Okonsky

*Attorney, Agent, or Firm*—Senniger, Powers, Leavitt and Roedel

[57] ABSTRACT

A lamp socket and light fixture connection wherein the fixture comprises a tube receiving wiring for the socket, the tube having an abutment spaced from one end and an external screw thread on its end portion outward of the abutment, the thread defining a helical groove, the socket being adapted to be slid on the screw-threaded end portion of the tube and carrying a detent which passes by the thread to enable the socket to be slid on the end portion, the detent being engageable in the helical groove for screwing the socket into firm engagement with the abutment with limited rotation of the socket, following the sliding of the socket on the end portion.

22 Claims, 15 Drawing Figures

LAMP SOCKET AND LIGHT FIXTURE CONNECTION

BACKGROUND OF THE INVENTION

This invention relates to lamp socket and light fixture connections, more particularly to a mode of assembling a lamp socket with a tubular arm of a chandelier, the tubular arm receiving wiring for the socket.

The conventional mode of assembly of a lamp socket with the end of a tubular arm of a chandelier has been to provide a screw thread on the free end of the arm and a screw thread in the socket and to screw the socket on the end of the arm. This has generally been a slow and tedious procedure, however, particularly where the arm is a bent arm, because the wiring in the arm twists and retards the screwing of the socket on the end of the arm.

SUMMARY OF THE INVENTION

Among the several objects of this invention may be noted the provision of an improved lamp socket and light fixture connection which enables secure screw-threaded fastening of the socket to the fixture without undue twisting of the wiring to speed up the assembly by avoiding retardation due to twisting of the wiring; the provision of such a connection especially for a lamp socket and arm of a chandelier; and the provision of such a connection which is of relatively simple, economical construction and easy to use.

In general, in a lamp socket and light fixture connection of this invention, the fixture comprises a tube having a free end portion for application of the socket with an external screw thread thereon defining a helical groove. The socket has a recess at one end thereof for receiving the base of a light bulb and applicable at its other end to the free end portion of the tube by sliding it thereon. An abutment associated with the tube is engageable by the socket. A detent is associated with the socket for engagement in said helical groove, said detent being movable relative to the socket between a retracted position wherein it may pass by the thread on application of the socket to said threaded end portion of the tube to an extended position in said helical groove. The socket is rotatable on its axis with said detent in its said extended position in said groove for screwing the socket on said threaded end portion of the tube into firm engagement with said abutment with limited rotation of the socket.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
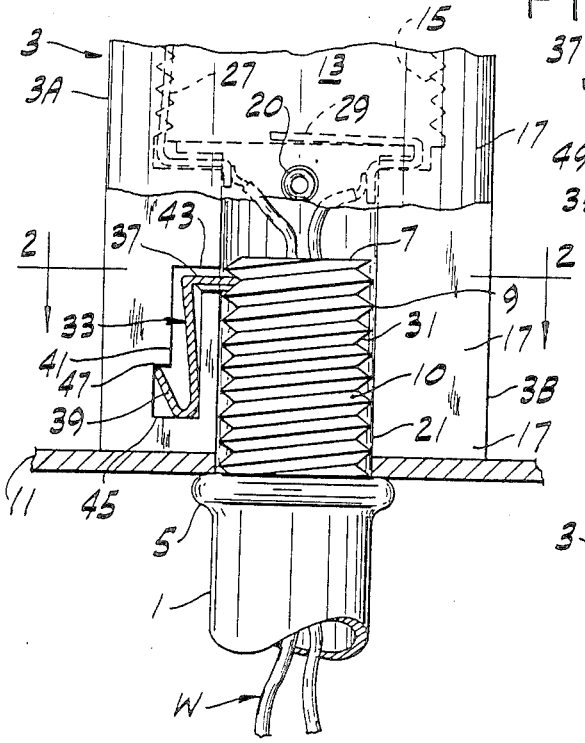
FIG. 1 is a view in elevation with parts broken away on a relatively large scale of a first embodiment of a lamp socket and chandelier arm connection of this invention.
Figure 2:
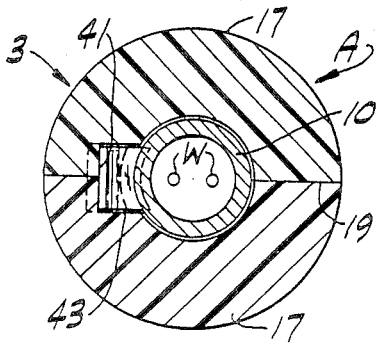
FIG. 2 is a transverse section on line 2—2 of FIG. 1 on a smaller scale.

Referring first to FIGS. 1 and 2 of the drawings, there is shown a first embodiment of the lamp socket and light fixture arm connection of this invention, the arm of this connection being indicated at 1 and the socket being designated 3. The arm, which may be the arm of a chandelier such as shown in U.S. Pat. No. 4,477,866, for example, comprises a metal tube which may be bent as shown in said U.S. Pat. No. 4,477,866 to have an upwardly extending outer end to which the socket is attached with the socket extending upwardly therefrom, as illustrated in FIG. 1. The arm or tube 1, which receives the wiring W for the socket as will be readily understood, is formed with an outwardly extending integral annular bead 5 extending all around the tube spaced down from the end 7 of the tube, constituting its free end, and is further formed with an external screw thread as indicated at 9 on the end portion 10 thereof outward of (above) the bead. As shown in FIG. 1, a flat annular member 11 is seated on the bead, this member constituting an abutment for the lower end of the socket, as will appear. The annular member or abutment 11 may be the bottom of a cup as conventionally used in chandeliers for holding a globe (not shown) enclosing the lamp bulb (not shown) screwed in the socket.

The socket 3, as illustrated herein, is a twopiece molded plastic socket of elongate cylindrical form having a main body portion 3A which has a recess 13 therein at one end of the socket (its upper end as shown) with a screw thread 15 in the recess for screwing in the base of a lamp (a light bulb), and an attachment means 3B constituted by an extension of the main body portion at the other (lower) end of the socket. As shown, this attachment means or extension 3B, which may also be referred to as the base of the socket, has the same diameter as the upper main body portion 3A. Also as illustrated herein, the socket comprises two halves each designated 17 of semicylindrical form which mate on an axial plane of the socket, the flat faces of the two halves being indicated at 19. The two halves may be held together in any suitable conventional manner, as by a rivet as indicated at 20 in FIG. 1, or a screw. The extension 3B (the attachment means) of the socket is formed to have a cylindrical opening or passage 21 of smaller diameter than the recess 13 extending axially with respect to the socket upwardly from its end opposite the recess (its lower end). This opening or passage 21 is of slightly larger diameter than the outside diameter of the screw thread 9 on the upper end of the tube 1 and connects with recess 13 for passage of the wiring W from the recess 13 down into the opening 21 and thence through and down out of the opening 21 and through the tube 1. The wiring, at its upper end, is attached in conventional manner to metal contacts 27 and 29 in the recess 13, as will be readily understood. The opening or passage 21 is somewhat longer (higher) than the length of the end portion 10 of the tube from the annular member or abutment 11 to the upper free end 7 of the tube so that the lower end of the socket is engageable with the abutment.

The screw thread 9 defines a helical groove 31. The socket carries a member indicated in its entirety at 33 comprising a strip of springy sheet metal bent to have a straight shank portion 35 having a finger 37 constituting a detent extending at somewhat less than a right angle to the shank 35 in one direction at one end (the upper end) of the shank, and a bent-back hook portion 39 at the other end (the lower end) of the shank extending in the opposite direction from the finger or detent 37. The two halves 17 of the socket 3 are formed with a recess or pocket 41 for the member 33, the pocket having an elongate portion extending lengthwise of the socket 3 for receiving the shank 35 of the detent, a lateral opening 43 at one end of the pocket constituting what may be referred to as its upper end receiving the finger or detent 37, and an enlargement 45 at the other end of the pocket receiving the hook member 37. As shown in FIG. 2, the pocket 41 may be formed half in one of the halves 17 of the socket, and half in the other half of the socket, enabling insertion of the member 33 in place on assembly of the two halves of the socket.

Figure 3:
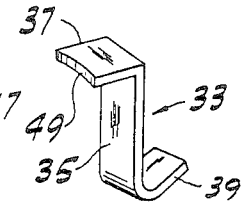
FIGS. 3 and 4 are views of a detent member per se used in the first embodiment.
Figure 4:
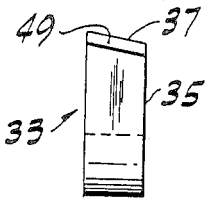

As lodged in the pocket 41, the member 33 has its finger constituting detent 37 extending radially with respect to the socket through the lateral opening 43 into the axial opening 21 and the end of its hook portion 37 engaging a shoulder 47 at the top of the enlargement 45. The detent is adapted to be pushed back into the opening 43 against the inherent spring bias of member 33 (the intermediate portion 35 of which acts like a leaf spring). Thus, the detent 37 is spring-biased toward an extended position wherein it projects into the opening 21 and is adapted to be pushed outwardly back into the opening 43 against the spring bias to a retracted position wherein its end is withdrawn from the opening 21. The arrangement is thus such that on application of the socket 3 to the free end portion 10 of the tube 1, the detent 37 is sprung back to its retracted position on engagement with the thread 9 in order to clear the thread. In the assembly of the socket 3 with the free end portion 10 of the tube 1, the socket is slid down (pushed down) on the free end portion of the tube to a point where the base end of the socket either engages or is very close to engagement with the abutment 11 and the detent 37 is in its extended position projecting out of opening 43 into the helical groove 31 of the thread 9, as shown in FIG. 1. Then, the socket 3 is rotated on its axis to screw it down on the free end portion 10 of the tube 1 to the point where the base end of the socket is in secure engagement with the abutment 11, the detent travelling around in the helical groove 31 for this purpose. Generally, only a fraction of a turn is needed and hence the wiring W is not unduly twisted and the assembly is quick and easy, without impediment. As appears in FIGS. 3 and 4 the detent 37 may be shaped to conform generally to the angle of the helical groove 31 and may have its edge 49 curved to conform to the circular form of the helical groove.

Figure 5:
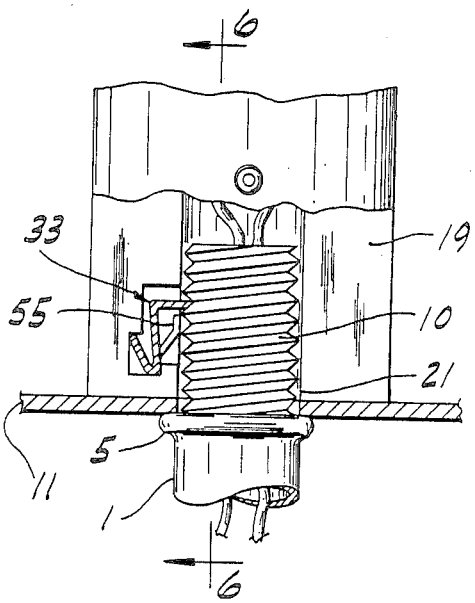
FIG. 5 is a view similar to FIG. 1 of a second embodiment.
Figure 7:
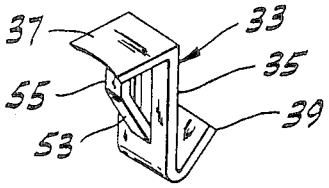
FIG. 7 is a view of a detent member per se used in the second embodiment.
Figure 6:
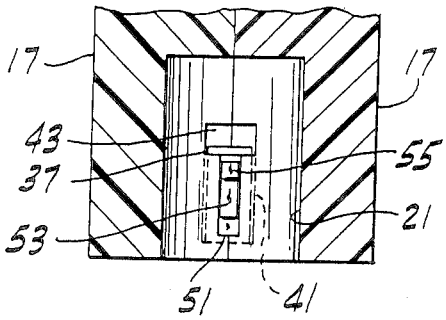
FIG. 6 is a vertical section generally on line 6—6 of FIG. 5.

FIGS. 5 and 6 illustrate a second embodiment of the connection of this invention corresponding essentially to the FIG. 1 embodiment except that the pocket 41 is formed to provide a slot 51 extending lengthwise thereof at the inside open to the axial opening 21, and the intermediate portion 35 of the member 33 is formed with a struck-out tab 53 which extends up toward the detent 37 (see also FIG. 7). The tab 53 slides in the slot 51 with its upper end 55 projecting into the opening 21 a predetermined distance, e.g. a distance such that the upper end of the tab, when unconfined, is set back with respect to the edge 49 of the detent by an amount generally equal to the depth of the helical groove 31. With this arrangement, the intermediate portion 35 of the member 33 is sprung out by the tab to retract the detent 37 before it reaches the upper end 7 of the free end portion 10 of the tube 1 to avoid binding, while enabling the detent to spring back into the helical groove 31.

Figure 8:
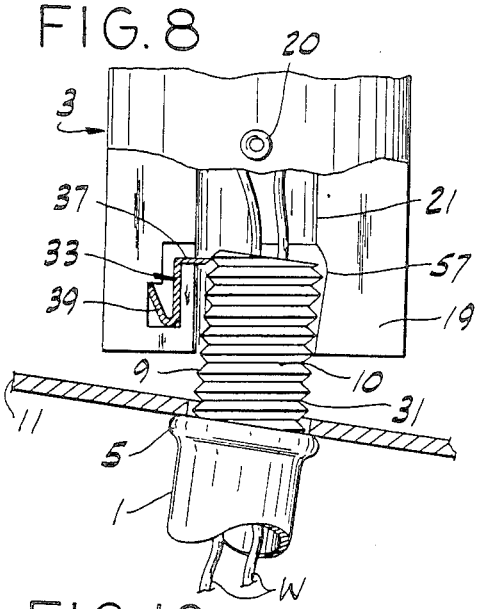
FIG. 8 is a view similar to FIG. 1 of a third embodiment.

FIG. 8 illustrates a third embodiment corresponding essentially to the FIG. 1 embodiment but with an enlargement of the opening 21 as indicated at 57 opposite the detent 37 to permit cocking of the free end portion 10 of the tube 1 relative to the socket 3 on assembly to enable the end of the tube relatively freely to pass by the detent.

Figure 9:
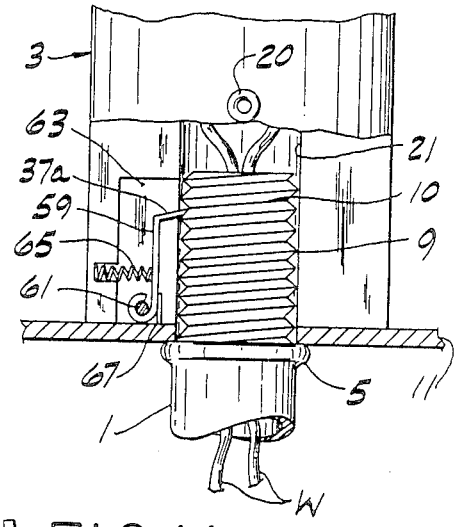
FIG. 9 is a view similar to FIG. 1 of a fourth embodiment.

FIG. 9 illustrates a fourth embodiment corresponding essentially to the FIG. 1 embodiment except that the detent, here designated **37*a*, extends as a finger from the upper end of an arm 59 pivoted at its lower end on a pin 61 which extends across a slot 63 formed in the two halves 17 of the socket 3. The arm 59 is biased by a small compression spring 65 to swing clockwise as viewed in FIG. 9 to a position determined by its engagement with a stop 67 molded in the pocket wherein the detent 37*a* extends out of the slot 63 and projects into the axial opening 21. The detent is adapted to be pushed outwardly back into the slot 63 against the bias of spring 65 to a retracted position wherein its end is withdrawn from the opening 21 for the assembly of the socket with the free end portion 10 of the tube 1, as in the assembly of the embodiments of FIG. 1 and 5**.

Figure 10:
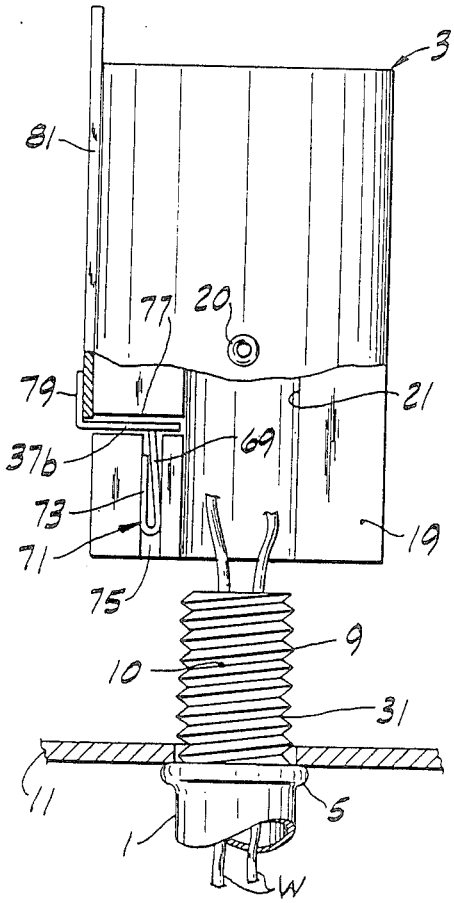
FIG. 10 is a view of a fifth embodiment before attachment of the socket to the arm.
Figure 11:
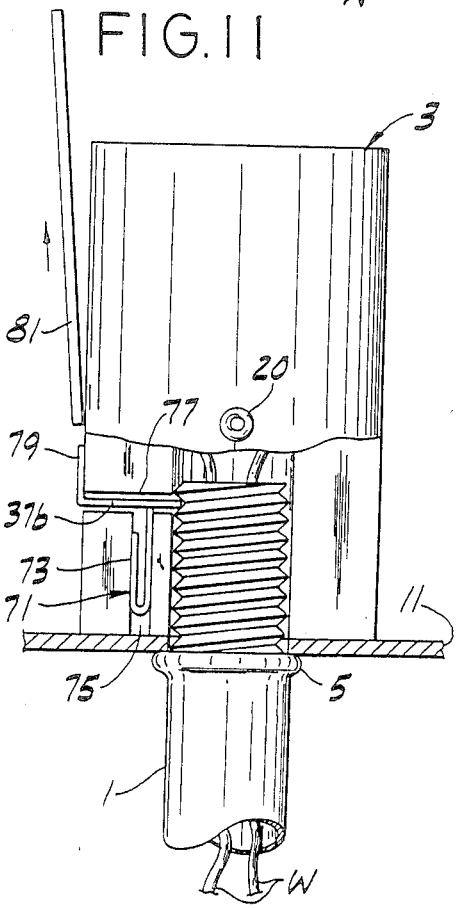
FIG. 11 is a view of the fifth embodiment with the socket attached to the arm.

FIGS. 10 and 11 i11ustrate a fifth embodiment wherein the detent, here designated **37*b*, comprises a relatively long strip, preferably a strip of sheet metal, at the upper end of one branch 69 of a hairpin spring member designated in its entirety by the reference numeral 71, the other branch of this spring member being designated 73. The hairpin spring member, which is preferably formed of springy sheet metal strip, is pocketed apex end down under compression in a slot 75 extending lengthwise of the socket 3 alongside the opening 21, with the detent 37*b* (at the head of the branch 69 of the hairpin spring member) movable radially in and out with respect to the socket in a lateral slot 77 at the head of the longitudinal slot 75. The lateral slot 77 extends all the way from the outside of the socket to the opening 21. The detent 37*b* has an upwardly extending finger 79** at its outer end.

The socket of the embodiment of FIGS. 10 and 11, as supplied for assembly with the free end portion 10 of the tube 1, has associated therewith means for holding the detent **37*b* back against the bias of the hairpin spring member 71 in a retracted position with the inner end of the detent withdrawn from the opening 21, this means being shown in FIG. 10 as a strip 81 of any suitable material (e.g. a strip of cardboard) interposed between the finger 79 at the outer end of the detent and the outside of the socket (see FIG. 10). After the socket is slid onto the free end portion 10 of the tube 1, the strip 81 is pulled out from between the finger 79 and the outside surface of the socket as shown in FIG. 11, releasing the detent to be sprung radially inwardly by the hairpin spring member 73 to the extended position shown in FIG. 11 wherein its inner end is in the helical groove 31 for the ensuing screwing down of the socket on the free end portion 10 of the tube 1 into firm engagement with the abutment 11. The slots 75 and 77** may be readily formed half in one of the halves of the socket and half in the other half of the socket.

Figure 12:
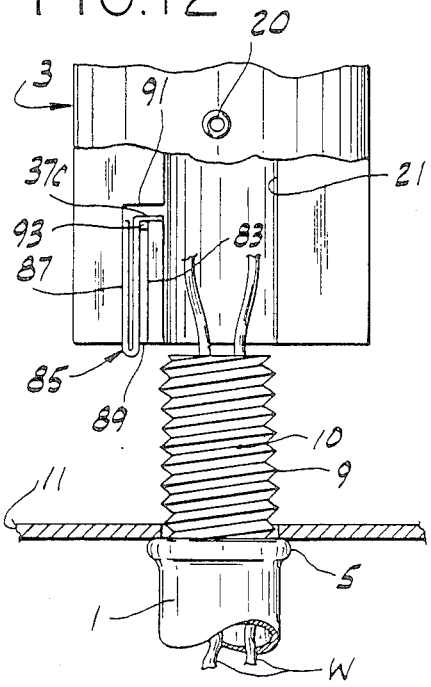
FIGS. 12–15 are views of sixth, seventh, eighth and ninth embodiments before attachment of the socket to the arm.

FIG. 12 illustrates a sixth embodiment wherein the detent, here designated 37*c*, comprises a finger bent to extend laterally from the upper end of one branch 83 of a hairpin spring member designated in its entirety by the reference numeral 85, the other branch of the spring member, which is shorter than branch 83, being designated 87. The member 85, including the detent 37*c*, is preferably formed of springy sheet metal strip. The socket 3 of FIG. 12 has a slot 89 extending up from its lower end alongside the opening 21 to a lateral opening 91 which extends generally radially inwardly from the upper end of the slot 89 to the opening 21. As the socket 2 of FIG. 12 is supplied for assembly with the free end portion 10 of the tube 1, the spring member 85 is pocketed under compression in the slot 89 extending lengthwise in the slot with its apex end down and projecting down out of the lower end of the slot 89, and with the detent in a lowered position in the lateral opening 91 and held back in retracted position withdrawn from opening 21 by engagement of a small lug 93 on branch 83 directly below the detent with the portion of the socket at the inside of the slot 89 at the upper end of the slot 89.

In the assembly of the socket of the FIG. 12 embodiment with the free end portion 10 of the tube 1, the socket is slid down on the end portion 10 generally to the point where the lower end of the socket engages the abutment 11. In the course of this step of the assembly, the lower end of the hairpin spring member 85 engages the abutment 11, and the spring member is pushed up bodily relative to the socket to the point where the lug 93 registers with the lateral opening 91, releasing the detent 37*c* to be sprung radially inwardly by the hairpin spring member 85 to the extended position (not shown) wherein its inner end is in the helical groove 31 of the free end portion 10 of the tube 1 for the ensuing screwing down of the socket on portion 10 of the tube into firm engagement with the abutment.

Figure 13:
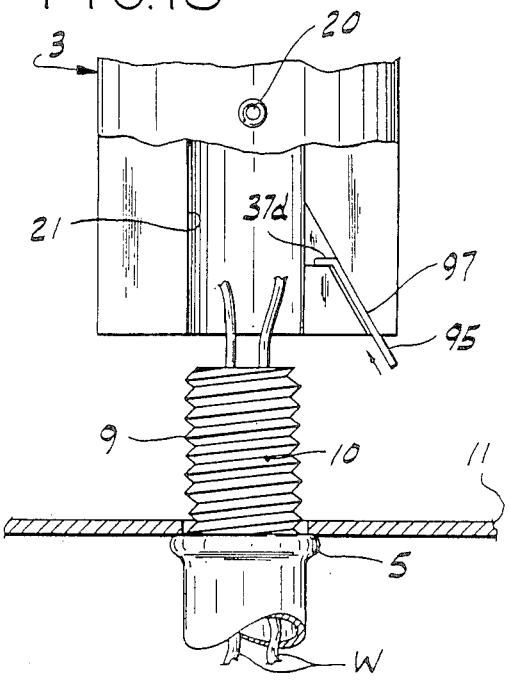

FIG. 13 illustrates a seventh embodiment wherein the detent, here designated 37*d*, comprises a finger at the upper end of a member 95 mounted for sliding movement at an angle to the axis of the socket in an opening such as indicated at 97 in its socket, with the lower end of the member on slider 95 extending down out of the openin 97 below the bottom of the socket. As the socket of the FIG. 13 embodiment is supplied for assembly with the free end portion of the tube 1, the member 95 is in the downward retracted position in which it is illustrated in FIG. 13 with the detent 37*d* withdrawn from the opening 21 and with the lower end of member 95 extending down below the lower end of the socket. In the assembly of the socket of the FIG. 13 embodiment with the free end portion 10 of the tube 1, the socket is slid down on the free end portion 10 of the tube generally to the point where its lower end engages the abutment 11, and in the course of this step, the lower end of member 95 engages the abutment 11 and member 95 is pushed up (and in) relative to the socket for movement of the detent 37*d* to its extended position (not shown) wherein its inner end is in the helical groove 31 of the free end portion 10 of the tube 1 for the subsequent screwing down of the socket on portion 10 of the tube into firm engagement with the abutment 11.

Figure 14:
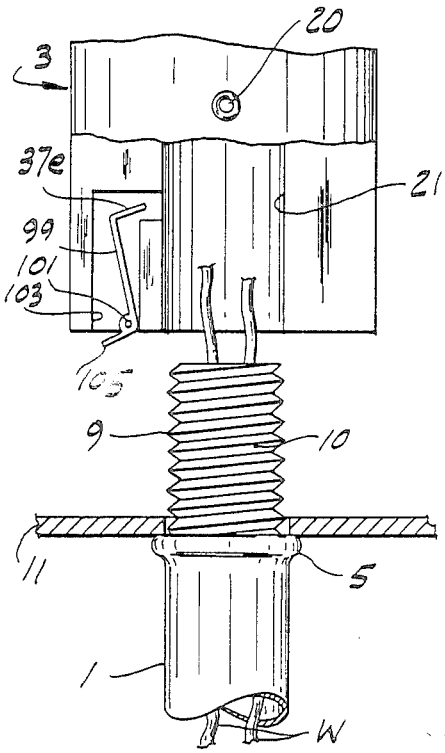

FIG. 14 illustrates an eighth embodiment wherein the detent, here designated 37*e*, comprises a finger at the upper end of an arm 99 pivoted at 101 in a slot 103 in the socket, the arm having a tail 105 which extends down out of the slot 103 below the bottom of the socket for engagement with abutment 11 to swing the detent into the helical groove.

Figure 15:
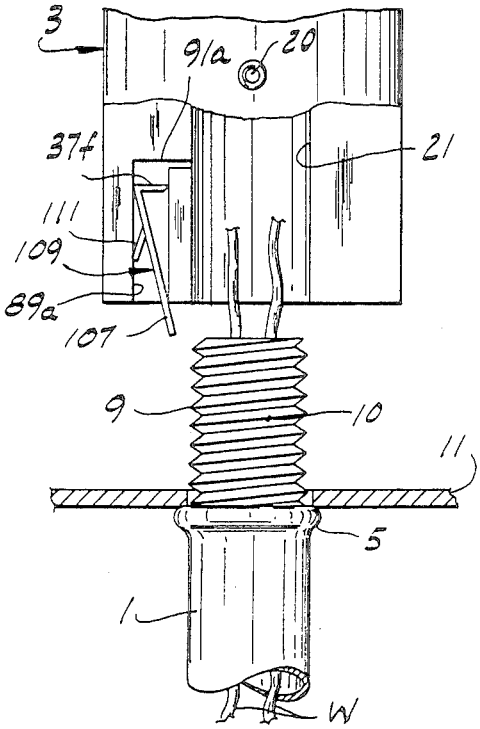

FIG. 15 illustrates a ninth embodiment involving a variation of the FIG. 12 embodiment wherein the detent, here designated 37*f*, comprises a finger at the upper end of a leg 107 of a spring member designated in its entirety by the reference numeral 109. The leg 107 of the spring member 109 is initially disposed (before the assembly operation) at an angle in the slot 89*a* slanting away from opening 21 in upward direction, with the detent 37*f* down in the slot below the opening 91*a*, and has a spring leg 111 struck from leg 107 angled in the opposite direction wedged in the slot 89. The leg 107 initially extends down out of the slot 89*a* below the lower end of the socket with the arrangement such that on assembly of the socket with the free end portion 10 of the tube 1 in the manner previously described, the member 109 is moved upwardly relative to the socket by the engagement of the lower end of leg 107 with abutment 11, and this brings the detent to the lateral opening 91*a*, whereupon it springs inwardly into the helical groove 31 for the subsequent screwing down of the socket in the manner previously described.

It will be observed that in each of the embodiments of FIGS. 1, 5, 8 and 9, the detent is spring-biased toward its extended position and moved back to its retracted position by its engagement with the thread 9 on the application of the socket 3 to the threaded free end portion 10 of the tube 1. In the embodiment shown in FIGS. 10 and 11, again the detent is spring-biased toward its extended position, but is held back in its retracted position by means (strip 81) which is manually removable following the application of the socket to the threaded end portion of the tube. In each of the embodiments of FIGS. 12–15, the detent has means associated therewith (the member which carries the detent) engageable with the abutment 11 for effecting movement of the detent to its extended position on application of the socket to the threaded end portion of the tube. And as to each embodiment the socket 3 is adapted for secure screw-threaded fastening to the free end portion 10 of the arm 1 by a simple sliding application of the socket to the end portion 10 and subsequent rotation of the socket through, generally, a fraction of a revolution, with hardly any twisting of the wiring W.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A lamp socket and light fixture connection, the fixture connection comprising a tube having a free end portion, for application of the socket, with an external screw thread thereon defining a helical groove, the socket having a recess at one end thereof for receiving a base of a light bulb and applicable at an opposite end to the free end portion of the tube by attaching it thereon, an abutment associated with the tube engageable by the socket, a detent associated with the socket for engagement in said helical groove, said detent being movable relative to the socket between a retracted position wherein it may pass by the thread on application of the socket to said threaded end portion of the tube to an extended position where it is in engagement with said helical groove, the socket being rotatable about a central axis with said detent in its said extended position in said helical groove for screwing the socket on said threaded end portion of the tube into firm engagement with said abutment with limited rotation of the socket.

2. A connection as set forth in claim 1 wherein the detent is spring-biased toward its extended position and is moved back to retracted position by its engagement with said thread on application of the socket to said threaded end portion of the tube.

3. A connection as set forth in claim 1 wherein the socket has an opening at its opposite end for receiving said screw-threaded end portion of the tube, said opening being of slightly larger diameter than an external diameter of and longer than said screw-threaded end portion of the tube, wiring extending through said opening.

4. A connection as set forth in claim 3 wherein said detent is spring-biased toward its extended position and wherein there is provided means for holding it in its retracted position which means is manually removable following the application of the socket to said threaded end portion of the tube for releasing said detent to move to its extended position.

5. A connection as set forth in claim 3 wherein said detent has means associated therewith engageable with the abutment for effecting movement of said detent to its extended position on application of the socket to said threaded end portion of the tube.

6. A lamp socket and light fixture connection, the fixture connection comprising a tube receiving for the socket, the tube having means forming a radially extending abutment spaced from one end, said one end having a portion constituting its free end and an external screw threa on the free end portion outward of the abutment, the thread defining a helical groove, the socket having a recess at one end thereof for receiving a base of a light bulb and attachment means at an opposite end adapted for application to the free end portion of the tube by attaching the socket onto said free end portion, said attachment means being engageable with said abutment, a detent associated with said attachment means for engagement in said helical groove, said detent being movable relative to the socket between a retracted position wherein it may pass by the thread on application of the socket to said threaded end portion of the tube to an extended position wherein it is in engagement with said helical groove, the socket being rotatable about a central axis with said detent in its said extended position in said helical groove for screwing the socket on said threaded end portion of the tube into firm engagement with said abutment with limited rotation of the socket.

7. A connection as set forth in claim 6 wherein the detent is spring-biased toward its extended position and is moved back to retracted position by its engagement with said thread on application of the socket to said threaded end portion of the tube.

8. A connection as set forth in claim 6 wherein said attachment means comprises an extension of the socket having an opening therein for receiving said screw-threaded end portion of the tube, said opening being of slightly larger diameter than an external diameter of and longer than said screw-threaded end portion of the tube, the wiring extending through said opening.

9. A connection as set forth in claim 8 wherein said detent is spring-biased toward its extended position and wherein there is provided means for holding it in its retracted position which means is manually removable following the application of the socket to said threaded end portion of the tube for releasing said detent to move to its extended position.

10. A connection as set forth in claim 8 wherein said detent has means associated therewith engageable with the abutment for effecting movement of said detent to its extended position on application of the socket to said threaded end portion of the tube.

11. A connection as set forth in claim 6 wherein the fixture is a chandelier and the tube is an arm of the chandelier.

12. A connection as set forth in claim 11 wherein the detent is spring-biased toward its extended position and is moved back to retracted position by its engagement with said thread on application of the socket to said threaded end portion of the tube.

13. A connection as set forth in claim 11 wherein said attachment means comprises an extension of the socket having an opening therein at its said opposite end for receiving said screw-threaded end portion of the tube, said opening being of slightly larger diameter and longer than the external diameter of said screw-threaded end portion of the tube, the wiring extending through said opening.

14. A connection as set forth in claim 13 wherein said detent is spring-biased toward its extended position and wherein there is provided means for holding it in its retracted position which means is manually removable following the application of the socket to said threaded end portion of the tube for releasing said detent to move to its extended position.

15. A connection as set forth in claim 13 wherein said detent has means associated therewith engageable with the abutment for effecting movement of said detent to its extended position on application of the socket to said threaded end portion of the tube.

16. A connection as set forth in claim 12 wherein the socket has an axial opening receiving the screw-threaded free end portion of the tube and the detent is integral with a spring member held in a recess in the socket and extends through a lateral opening from the recess to said axial opening.

17. A connection as set forth in claim 16 wherein the spring member has a tab extending through a slot in the socket into the axial opening in the socket for moving the detent outwardly as the socket is slid on to the screw-threaded free end portion of the tube.

18. A connection as set forth in claim 16 wherein the axial opening has an enlargement opposite the detent.

19. A connection as set forth in claim 14 wherein the detent extends to the outside of the socket and has a finger at its outer end, and the manually removable means is interposed between the finger and the outside of the socket.

20. A connection a set forth in claim 15 wherein the means engageable with the abutment comprises spring means for biasing the detent for movement to its extended position.

21. A connection as set forth in claim 15 wherein the means engageable with the abutment is slidable at an angle to the axis of the socket.

22. A connection as set forth in claim 15 wherein the detent is on a pivoted member having a part engageable with the abutment.

* * * * *